US009344818B2

(12) United States Patent
Cho et al.

(10) Patent No.: US 9,344,818 B2
(45) Date of Patent: May 17, 2016

(54) EASILY INSTALLABLE MICROPHONE FOR IMPLANTABLE HEARING AID

(71) Applicant: Kyungpook National University Industry-Academic Cooperation Foundation, Daegu (KR)

(72) Inventors: Jin-Ho Cho, Daegu (KR); Kyu-Yup Lee, Daegu (KR); Hyung Gyu Lim, Daegu (KR); Ki-Woong Seong, Daegu (KR); Jyung Hyun Lee, Gyeongsangbuk-do (KR); Seong Tak Woo, Daegu (KR)

(73) Assignee: Kyungpook National University Industry-Academic Cooperation Foundation, Daegu (KR)

( * ) Notice: Subject to any disclaimer, the term of this patent is extended or adjusted under 35 U.S.C. 154(b) by 0 days.

(21) Appl. No.: 14/185,135

(22) Filed: Feb. 20, 2014

(65) Prior Publication Data

US 2014/0314262 A1 Oct. 23, 2014

(30) Foreign Application Priority Data

Feb. 20, 2013 (KR) ..... 10-2013-0017827
Feb. 5, 2014 (KR) ..... 10-2014-0013228

(51) Int. Cl.
*H04R 25/00* (2006.01)

(52) U.S. Cl.
CPC ..... *H04R 25/60* (2013.01); *H04R 25/606* (2013.01); *H04R 2410/03* (2013.01)

(58) Field of Classification Search
USPC ..... 381/324, 317, 329, 326, 380, 328, 312, 381/322; 600/25; 607/55, 56, 57; 623/10
See application file for complete search history.

(56) References Cited

U.S. PATENT DOCUMENTS 1,346,721 A * 7/1920 Prenn ..... A61F 11/008 181/137
3,985,960 A * 10/1976 Wallace, Jr. ..... 381/309

(Continued)

FOREIGN PATENT DOCUMENTS

EP 0548580 A1 6/1993
IT EP 1035753 A1 * 9/2000 ..... H04R 25/606

OTHER PUBLICATIONS

Ko et al., "Studies of MEMS Acoustic Sensors as Implantable Microphones for Totally Implantable Hearing-Aid Systems", IEEE Transactions on Biomedical Circuits and Systems, vol. 3, No. 5, Oct. 2009, pp. 277-285.

(Continued)

*Primary Examiner* — Fan Tsang
*Assistant Examiner* — Angelica M McKinney
(74) *Attorney, Agent, or Firm* — Carter, DeLuca, Farrell & Schmidt, LLP

(57) ABSTRACT

A microphone for an implantable hearing aid includes a body part having a cylindrical housing installed to pass through a tympanum and a microphone controller installed within the cylindrical housing to convert an acoustic signal into an electrical signal, an acoustic collection part that provides a passage for transmitting external sounds into the body part, the acoustic collection part being disposed on one end of the body part in a direction of an external auditory meatus, and a wire connection part connecting the microphone controller to the hearing aid, the wire connection part being disposed on the other end of the body part in a direction of a middle ear cavity. The microphone is easily installed on the tympanum in a noninvasive manner, and attenuation in sensibility of the microphone is prevented. Thus, the microphone may be significantly utilized for the implantable hearing aid.

14 Claims, 16 Drawing Sheets

(56) References Cited

U.S. PATENT DOCUMENTS

| | | | | |
|---|---|---|---|---|
| 4,744,792 | A * | 5/1988 | Sander et al. | 623/10 |
| 4,988,333 | A * | 1/1991 | Engebretson et al. | 600/25 |
| 5,220,918 | A * | 6/1993 | Heide et al. | 600/25 |
| 5,654,530 | A | 8/1997 | Sauer et al. | |
| 5,782,744 | A * | 7/1998 | Money | 600/25 |
| 5,881,158 | A | 3/1999 | Lesinski et al. | |
| 5,913,815 | A * | 6/1999 | Ball et al. | 600/25 |
| 6,261,223 | B1 * | 7/2001 | Brillhart et al. | 600/25 |
| 6,387,039 | B1 * | 5/2002 | Moses | 600/25 |
| 7,547,275 | B2 * | 6/2009 | Cho et al. | 600/25 |
| 7,983,435 | B2 * | 7/2011 | Moses | 381/326 |
| 8,211,174 | B2 * | 7/2012 | Park et al. | 623/10 |
| 2003/0220536 | A1 * | 11/2003 | Hissong | 600/25 |
| 2005/0090705 | A1 * | 4/2005 | Cho et al. | 600/25 |
| 2007/0154030 | A1 * | 7/2007 | Moses | H04R 25/606 381/72 |
| 2009/0248156 | A1 * | 10/2009 | Pizzoli et al. | 623/10 |
| 2009/0253951 | A1 * | 10/2009 | Ball et al. | 600/25 |
| 2009/0281367 | A1 * | 11/2009 | Cho | H04R 25/606 600/25 |
| 2010/0010628 | A1 | 1/2010 | Park et al. | |
| 2010/0183177 | A1 * | 7/2010 | Ruwisch | 381/317 |
| 2012/0014546 | A1 * | 1/2012 | Puria et al. | 381/320 |
| 2012/0257774 | A1 | 10/2012 | Larsen et al. | |
| 2013/0010992 | A1 * | 1/2013 | Koester et al. | 381/322 |
| 2014/0286514 | A1 * | 9/2014 | Pluvinage et al. | 381/328 |

OTHER PUBLICATIONS

Leysieffer et al., "A totally implantable hearing device for the treatment of sensorineural hearing loss: TICA LZ 3001", HNO, 1998 • 46:853-863.

Murali et al., "Totally implantable hearing aid surgical technique and the first Indian experience with Envoy esteem" Indian J Otolaryngol Head Neck Surg, (Jul.-Sep. 2009) 61:245-251.

Tringali et al., "Fully implantable hearing device as a new treatment of conductive hearing loss in Franceschetti syndrome", International Journal of Pediatric Otorhinolaryngology (2008) 72, pp. 513-517.

Cho et al., "Implantable Microphone in Middle Ear with Percutaneous Tympanic Membrane Tube for Implantable Hearing Aids", Biomedical Electronics Laboratory, abstract, p. 1.

Woo et al., "Characteristics for Fully-Implantable Middle Ear Hearing Devices", The Korean Sensors Society, Nov. 2013, abstract, pp. 1-2.

Cho, "Pioneering Path to Clinical Readiness in Biomedical Engineering", The 18th Annual Joint Workshop, 2013, pp. 1-3.

International Preliminary Examination Report and Written Opinion of the ISA, Application No. PCT/KR2014/001315 dated Sep. 3, 2015 and English translation.

* cited by examiner

EASILY INSTALLABLE MICROPHONE FOR IMPLANTABLE HEARING AID

CROSS-REFERENCE TO RELATED APPLICATIONS

This U.S. non-provisional patent application claims priority under 35 U.S.C. §119 of Korean Patent Application Nos. 10-2013-0017827, filed on Feb. 20, 2013, and 10-2014-0013228, filed on Feb. 5, 2014, the entire contents of which are hereby incorporated by reference.

STATEMENT REGARDING SPONSORED RESEARCH OR DEVELOPMENT

This work was supported by the National Research Foundation of Korea (NRF) grants funded by the Korea government (No. 2013R1A2A1A09015677) and this work was supported by a grant from the Korea Healthcare Technology R&D Project, Ministry of Health and Welfare (A092106).

BACKGROUND OF THE INVENTION

The present invention disclosed herein relates to a microphone, and more particularly, to an easily installable microphone for an implantable hearing aid.

According to statistics, there are more than seven billion people living around the globe. Among these, about 10% of persons suffer from hard of hearing. Here, a person who can be solved by conventional hearing aids is estimated to reach about 80% of persons that suffer from hard of hearing. Thus, the rest has a difficulty in compensation of hearing by using general air conduction hearing aids. This is done because, if the hearing is terribly deteriorated due to genetic problems, hearing loss by aging, and noise environments by construction or explosion in industrial settings, the persons who have difficulty in hearing does not understand sounds even though the sounds are amplified by using existing hearing aids. In two hearing aids that are used for the persons who cannot be satisfied by general hearing aids, one is a cochlear implant which converts sounds into electrical signals to stimulate acoustic nerves of a cochlea, and the other is a middle ear implant which amplify sound signal and then converts the amplified electrical signal into the mechanical vibration, thereby applying the amplified vibration to the auditory ossicles or a round window of the inner ear.

The cochlear implant that is commercialized in the current years to make up the largest market may be a semi-implantable hearing aid. Thus, a microphone, an amplifier, and a power source may require an external device that is attached or detached to the outside of a skin. One of widely known middle ear implant has been commercialized by MED-EL GmbH is currently available in the market. However, the commercialized middle ear implant is also the semi-implantable hearing aid up to now. Since all of the implantable hearing aids are the semi-implantable hearing aids and thus exposed to the outside, all and sundry may notice a person as a person who have difficulty in hearing in the state where the person wears the hearing aid. Thus, since the hearing aid is worn while one is out, and is separated when returning home, it is inconvenient to the user. As a result, the users that use the implantable hearing aid have been longing for completely implantable hearing aid instead of the semi-implantable hearing aid.

The most difficult technology in manufacturing of the completely implantable hearing aid may be an implantable microphone technology up to now. Major companies that manufacture the implantable hearing aids, such as Cochlear Co., Ltd., MED-EL GmbH, and Advanced Bionics Co., Ltd., have been constantly attempted to develop the completely implantable hearing aids for commercial scale. However, the commercialization of the completely implantable hearing aids has failed always due to deterioration in performance of the implantable microphone. Hereinafter, the typical implantable microphone and its limitations will be described.

(1) A completely middle ear implant has been developed by US Otologics Co., Ltd., are practically finished under way on a clinical demonstration. The implantable microphone that is used for this hearing aid may require an additional surgical operation due to the large size of microphone (a length of about 5 cm, a width of about 2.5 cm, and a depth of about 3 mm) for installing in addition to the implantation of a system body and vibrational transducer. If the above-described type microphone is used, following limitations may occur. When fingers, clothes, and pillow contact the surroundings of a skin that covers the microphone instated under a skin of ostemporale, or masticatory movement for eating foods is executed, noises may be directly applied to the microphone. Thus, it may be difficult to allow a user to hear speech sounds properly. Also, since the microphone is implanted under the skin, the microphone may be deteriorated in high frequency sensitivity.

(2) According to a TICA hearing aid (Germany) that is developed by Leysieffer, an implantable microphone is installed under a skin of an external auditory meatus. Thus, when sounds pass through a skin layer, attenuation may occur to reduce sensitivity. If the microphone is implanted at a shallow depth under the skin of the external auditory meatus to solve the above-described limitation, the microphone may not adhere to the tissues under the skin to protrude to the outside of the skin in long-term point of view. Thus, the TICA hearing aid does not put to practical use and thus is not studied any more.

(3) An implantable microphone that is proposed by Wen H. Ko may be classified into a MEMS microphone attached to a malleus behind a tympanum, a MEMS mass microphone, and a capacitive microphone. According to the method in which the MEMS microphone itself is attached to malleus which is behind the tympanum, sounds introduced through the external auditory meatus may be attenuated while passing through the tympanum to reduce the sensitivity. The MEMS mass microphone may respond acceleration velocity when the malleus itself is vibrated to generate electrical signals. However, this may be much deteriorated in a gain of low-frequency and high-frequency. Also, since the anchor has to be fixed to the wall of the middle ear cavity, a method for detecting capacitance's changes by the displacement of ossiculum that is vibrated according to the sounds by fixing an anchor to a wall of a middle ear cavity may have a difficulty in operation of implant.

(4) An Envoy system utilizes a tympanum as a vibrator of the microphone. According to this method, an anchor is formed on an end of a piezoelectric element to fix the anchor to a middle ear cavity wall to achieve displacement in which auditory ossicles such as a malleus or an incus are vibrated according to sounds as piezoelectric signals, thereby obtaining electrical signals. Also, it is necessary for a fixing process of the piezoelectric microphone by forming a hole in the middle ear cavity. Also, since feedback between an input and an output of the hearing aid occurs if the auditory ossicles are not removed, the auditory ossicles have to be physically separated. Thus, this method may be a very invasive method.

SUMMARY OF THE INVENTION

The present invention provides an implantable microphone which has a less influence on external motion noises, is easily operated, and has high sensitivity in an implantable hearing aid.

The technical objective of the present invention is not limited to the aforementioned technical problem, and technical problems not mentioned above can be clearly understood by a person skilled in the art by the disclosure below.

Embodiments of the present invention provide microphones for an implantable hearing aid, the microphones including: a body part including a cylindrical housing installed to pass through a tympanum and a microphone controller installed within the cylindrical housing to convert an acoustic signal into an electrical signal; an acoustic collection part that provides a passage for transmitting external sounds into the body part, the acoustic collection part being disposed on one end of the body part in a direction of an external auditory meatus; and a wire connection part connecting the microphone controller to the hearing aid, the wire connection part being disposed on the other end of the body part in a direction of a middle ear cavity.

In other embodiments of the present invention, microphones for an implantable hearing aid include: a body part including a first cylindrical housing installed to pass through a tympanum, a microphone controller installed within the cylindrical housing to convert an acoustic signal into an electrical signal, a wire connection part disposed on one end of the first cylindrical housing to connect the microphone controller to the hearing aid; and an acoustic collection part screw-coupled to the other end of the first cylindrical housing to collect external sounds, thereby transmitting the sounds into the body part.

In still other embodiments of the present invention, microphones for an implantable hearing aid include: a body part including a cylindrical housing installed to pass through a tympanum; an acoustic collection part that provides a passage for transmitting external sounds into the body part, the acoustic collection part being disposed on one end of the body part in a direction of an external auditory meatus; and an acoustic transfer part disposed on the other end of the body part in a direction of a middle ear cavity to transmit an acoustic signal into a microphone controller.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Advantages and features of the present invention, and implementation methods thereof will be clarified through following embodiments described with reference to the accompanying drawings. The inventive concept may, however, be embodied in different forms and should not be construed as limited to the embodiments set forth herein. Rather, these embodiments are provided so that this disclosure will be thorough and complete, and will fully convey the scope of the present invention to those skilled in the art.

Therefore, the embodiments of the present invention are not limited to the specific shape illustrated in the exemplary views, but may include other shapes that may be created according to manufacturing processes.

In the specification, 'and/or' means that it includes at least one of listed components. The terms of a singular form may include plural forms unless specifically mentioned. The meaning of "include or comprise", or "including or comprising" specifies a component, a step, an operation, an element, and a device but does not exclude other components, steps, operation, elements, and devices.

The present invention will now be described more fully with reference to the accompanying drawings, in which exemplary embodiments of the invention are shown.

Figure 1:
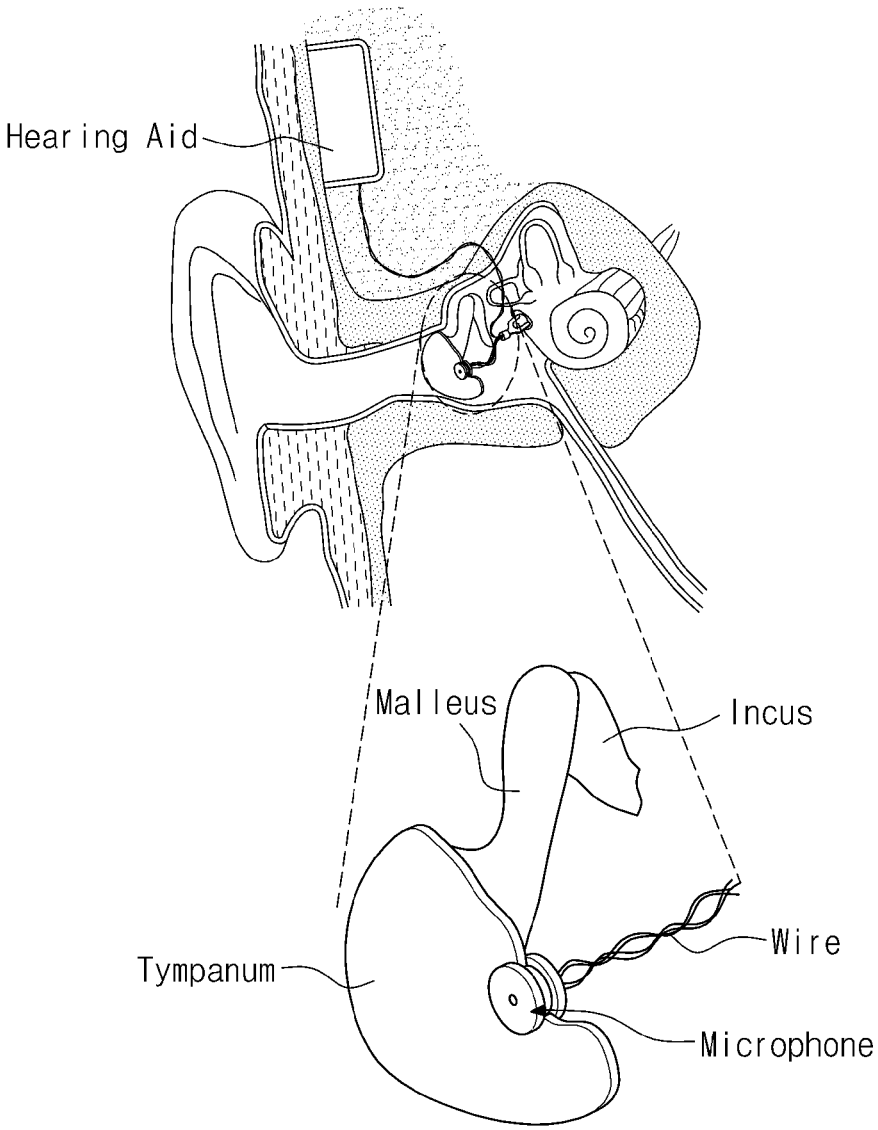
FIG. 1 is a schematic view of an installed state of an easily installable microphone for an implantable hearing aid according to an embodiment of the present invention.
Figure 2:
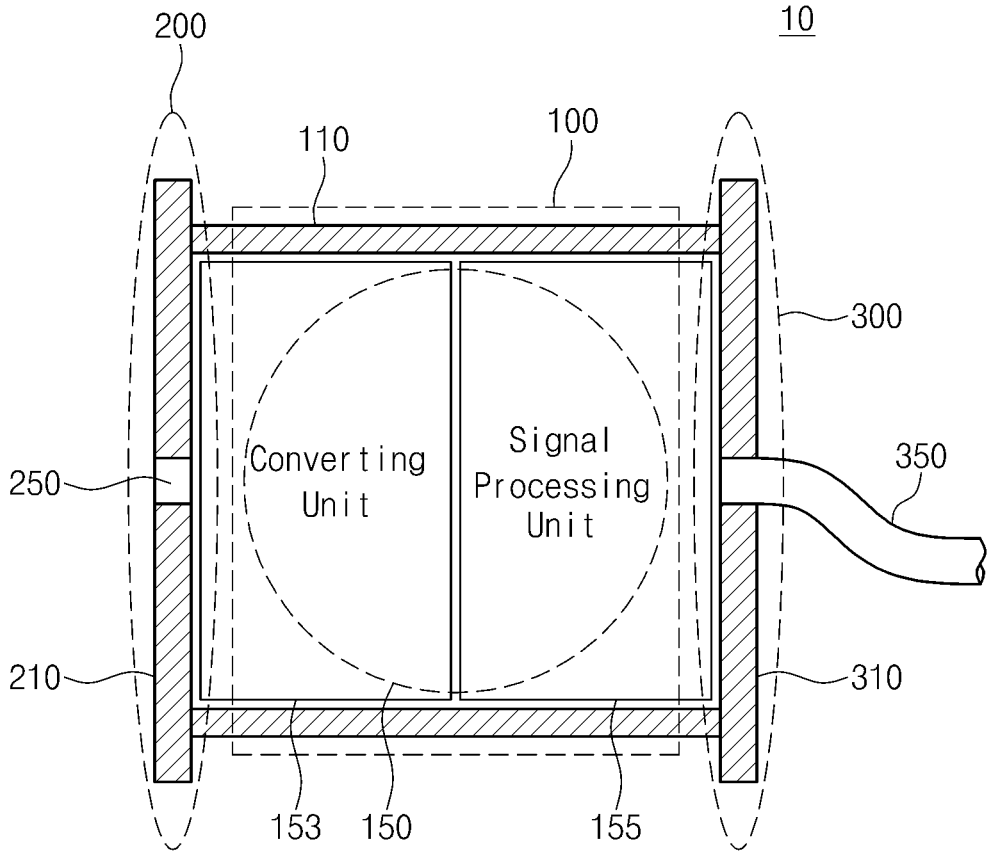
FIG. 2 is a cross-sectional view of the easily installable microphone for the implantable hearing aid according to an embodiment of the present invention.

FIG. 1 is a schematic view of an installed state of an easily installable microphone for an implantable hearing aid according to an embodiment of the present invention, and FIG. 2 is a cross-sectional view of the easily installable microphone for the implantable hearing aid according to an embodiment of the present invention.

Referring to FIGS. 1 and 2, an implantable microphone 10 according to an embodiment of the present invention includes a body part 100 including a cylindrical housing 110 that is installed to pass through a tympanum and a microphone controller 150 installed within the housing 110 to convert an acoustic signal into an electrical signal, an acoustic collection part 200 that provides a passage for transmitting external sounds into the body part 100, the acoustic collection part 200 being disposed on one side (a left side in drawings) that is a front surface of the body part 100 in a direction of an external auditory meatus, and a wire connection part 300 disposed on the other side (a right side in drawings) that is a rear surface of the body part 100 in a direction of a middle ear cavity, the wire connection part 300 extending to the microphone controller 150 and being connected to a hearing aid.

A typical implantable microphone may be implanted under a skin of ostemporale or external auditory meatus, a malleus behind a tympanum, or the middle ear cavity. Thus, a large-scale operation is needed. However, the embodiments of the present invention suggest a subminiature implantable microphone that passes through or crosses the tympanum and is seated by autogenic reproducibility of the tympanum. Thus, the subminiature implantable microphone may be provided as a high-performance implantable microphone that is used for a hearing aid. According to the high-performance implantable microphone, the microphone may be installed on the tympanum in a noninvasive manner and prevent the sensibility of the microphone from being attenuated.

That is, the embodiments of the present invention suggest an implantable microphone that is easily implanted in an operating room by a doctor without making wound on or cutting a patient's skin or ostemporale and without installing a screw anchor in the middle ear cavity or performing a punching process on the ostemporale toward a middle ear cavity and is simple in structure and operation.

Referring to FIG. 2, the implantable microphone 10 according to an embodiment of the present invention includes the cylindrical body part 100 in which a microphone device (a microphone or an integrated circuit for processing signals) is installed, the body part 100 being seated on the tympanum, the acoustic collection part 200 installed on the body part 100 in the direction of the external auditory meatus to collect external sounds, and one module in which the wire connection part 300 connecting the microphone device of the body part 100 to the hearing aid by using a wire is installed in the direction of the middle ear cavity of the body part 100.

Here, the body part 100 may be a cylindrical housing 110 (a titanium container) having a size very smaller than that of the tympanum and be installed to cross the tympanum. The subminiature and high-sensibility MEMS microphone controller 150 is installed within the body part 100 (the housing 110). The microphone controller 150 includes a MEMS converting unit 153 for an acoustic signal into an electrical signal and a signal processing unit 155 for amplifying the acoustic signal and removing noises.

Member having outer surfaces expanded from the housing 110, i.e., as illustrated in FIG. 2, circular plates 210 and 310 for finishing both ends of the body part 100 are disposed on one end and the other end of the housing 110. The body part 100 between the two circular plates 210 and 310 may be installed to pass through the tympanum.

The acoustic collection part 200 includes the circular plate 210 in the direction of the external auditory meatus and at least one acoustic passage 250 defined in a central portion of the circular plate 210. Thus, the acoustic collection part 200 may be a device for collecting external sounds introduced through the external auditory meatus. The wire connection part 300 include the circular plate disposed on an end of the body part 100 in the direction of the middle ear cavity and a wire 350 connecting the microphone controller installed within the housing 110 to the hearing aid. That is, the wire 350 of the wire connection part 300 includes draw lines constituted by a power line, a signal line, and a ground line in the direction of the middle ear cavity. The microphone 10 is connected to the body part of the implantable hearing aid of FIG. 1 through the draw lines.

Also, each of the circular plates 210 and 310 of the acoustic collection part 200 and the wire connection part 300 may have a diameter greater than that of the body part 100 (the housing 100). This is done because the microphone body part 100 according to an embodiment of the present invention stably adheres to the tympanum, and the circular plates 210 and 310 disposed on both ends of the body part 100 serve as one stepped portion to fix the microphone.

That is, as shown in FIG. 1, a hold may be punched in a center of a plane of a left or right lower end of the malleus. Thus, the tympanum may be reproduced after five days due to self-healing and recovery performance thereof to surround the body part 100, thereby naturally fixing the body part to the tympanum.

Also, although the device is continuously pushed outward from a central portion of the tympanum due to the tissue-reproducible performance of the tympanum, the microphone according to the embodiment of the preset invention may be seated on an edge of the tympanum after a long time passes. Thus, there is no problem to achieve an electrical signal by reacting on sound intensity.

In general, a ventilation tube having a weight of several mg is used in the tympanum as a unit for treating an inflammation in the middle ear. Thus, since the body part of the present invention is made of titanium having biocompatibility, there is no problem in clinical demonstration for ear implantation fields.

When the ventilation tube is installed on the tympanum, tympanum cells are grown by the biorecovery effect thereof to adhere to the titanium body part of the microphone. Thus, the tympanum may be supported the movement of the microphone to stably fix the microphone even though vibration or impacts are applied to a head.

Also, a wounded area of the ventilation tube disposed on the central portion of the tympanum may be physiologically grown in a radius direction. As a result, after several months or years are pass, the wounded area may be pushed toward an edge of the tympanum, and thus, the microphone may be pushed toward a middle ear cavity wall. However, even though the microphone is pushed toward the middle ear cavity wall so that the microphone is closely attached to the middle ear cavity, there is no problem in the implantable microphone because the microphone detects a signal according to a motion of a membrane (or diaphragm) within the implantable microphone, but does not detect a vibration of the tympanum.

Figure 3A:
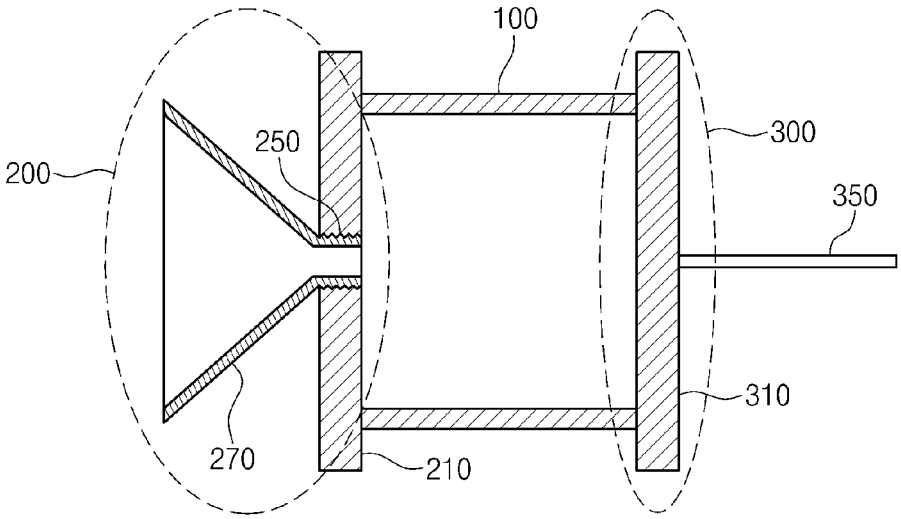
FIG. 3A is a cross-sectional view of an easily installable microphone for an implantable hearing aid according to another embodiment of the present invention.
Figure 3B:
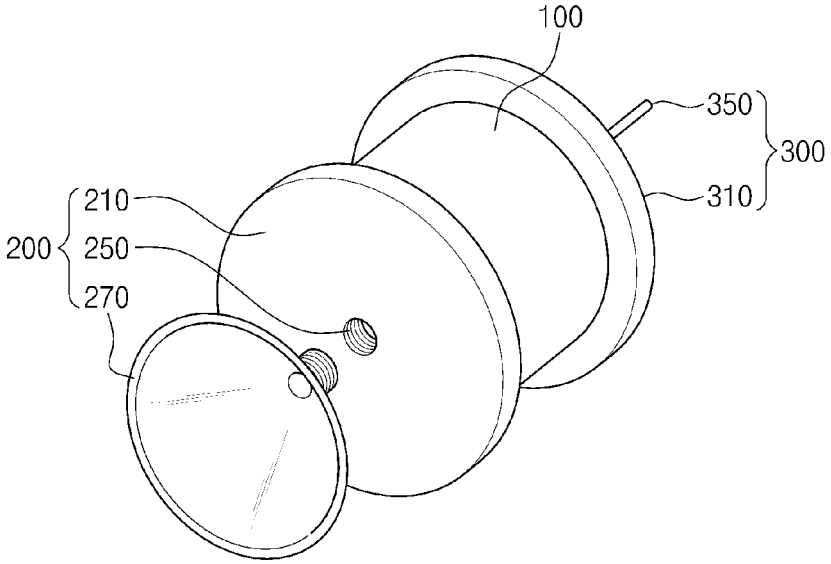
FIG. 3B is a perspective view of the easily installable microphone for the implantable hearing aid according to another embodiment of the present invention.

FIG. 3A is a cross-sectional view of an easily installable microphone for an implantable hearing aid according to another embodiment of the present invention, and FIG. 3B is a perspective view of the easily installable microphone for the implantable hearing aid according to another embodiment of the present invention. Referring to FIGS. 3A and 3B, the current embodiment has the same constitution as the foregoing embodiment of FIG. 2, except that an acoustic collection part 200 includes a circular plate 210, an acoustic passage 250 in a center of the circular plate 210, an acoustic collection tube 270 having a hopper shape and installed in the acoustic passage 250 to extend in the direction of the external auditory meatus.

That is, as illustrated in FIGS. 3A and 3B, in the microphone according to the current embodiment, a left side of the body part 100 that is installed to pass through the tympanum may correspond to an external auditory meatus side, and a right side may correspond to a middle ear cavity side. Thus, the acoustic collection part 200 having the acoustic passage having a diameter of about 0.5 mm is disposed on the left side of the body part 100, and a wire connection part 300 connected to the hearing aid is disposed on the right side of the body part 100. Also, the subminiature MEMS converting part is housed in the body part 100. A signal processing device such as an amplifying IC for the microphone is disposed in a space just adjacent to the subminiature MEMS converting part.

Also, each of circular plates 210 and 310 of the acoustic collection part 200 and the wire connection part 300 which are disposed on both sides of a cylindrical housing 110 of the body part 100 may have a diameter greater by about 1.2 times to about 1.5 times than that of the body part 100. Thus, when the microphone is installed on the tympanum, the tympanum may be cut to a size, that is enough to insert the circular plate, to push the implantable microphone according to the current embodiment. As a result, the tympanum tissue may be grown toward a central portion of the cylinder, and then, as the time elapses, the central portion may be filled to completely isolate the inside and outside of the tympanum from each other.

Thus, a pressure of the middle ear cavity may be adjusted by its original biomodulatory. Also, since a wire connection hole of the implantable microphone according to an embodiment of the present invention is sealed by biocompatible epoxy, the pressure of the middle ear cavity may be normally maintained. Each of the housing 110 of the body part 100 and the two circular plates 210 and 310 may be made of a biocompatible material. The wire 350 or the draw lines may also be made of a soft wire that is coated with biocompatible material (e.g., parylene).

As illustrated in FIGS. 3A and 3B, the acoustic collection part 200 of the microphone according to an embodiment of the present invention may have a structure in which an acoustic collection tube 270 having the hopper shape extends in the acoustic collection passage 250, unlike the embodiment of FIG. 2. This is done for effectively collecting sounds introduced through the external auditory meatus. Through the acoustic collection tube 270 having the hopper shape, the acoustic passage having a diameter gradually decreasing in one direction may be formed to more effectively transmit sounds to a narrow acoustic passage.

Figure 4A:
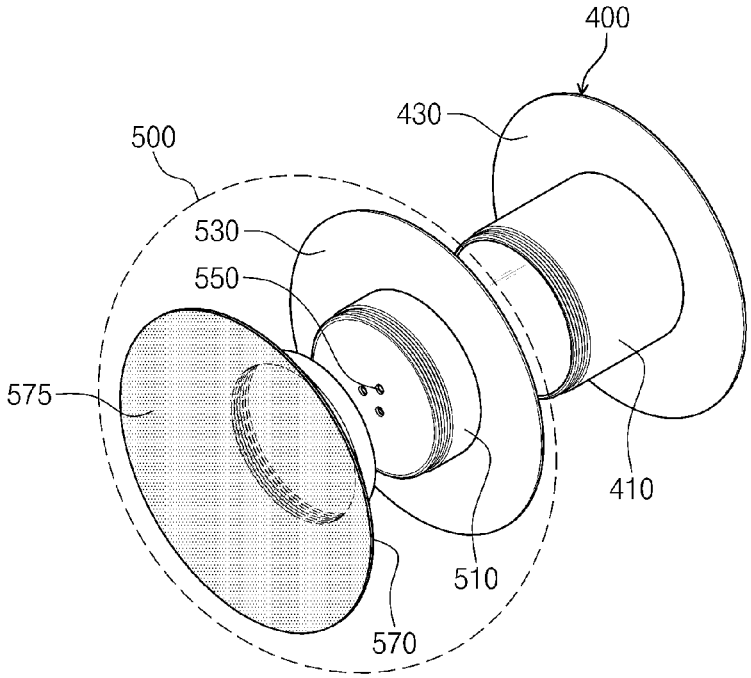
FIGS. 4A and 4B and 5 are exploded views of an easily installable microphone for an implantable hearing aid according to another embodiment of the present invention.
Figure 4B:
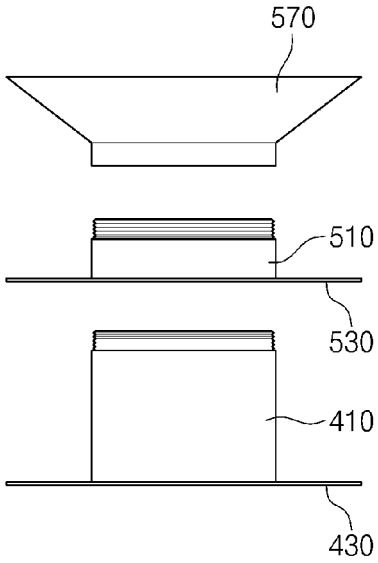
Figure 5:
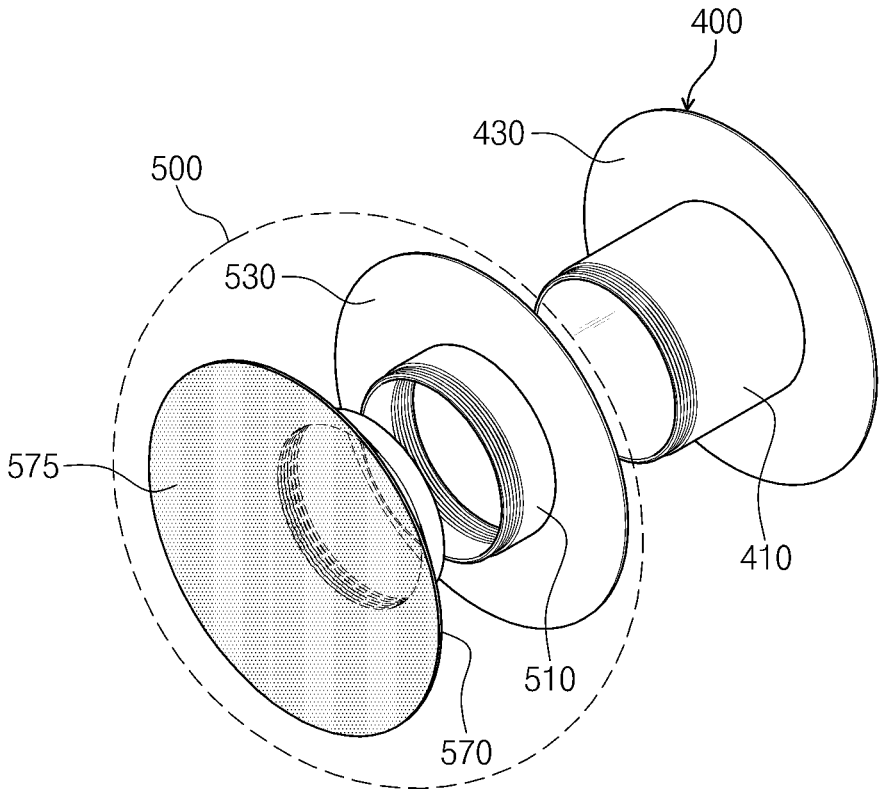

FIGS. 4A and 4B and 5 are exploded views of an easily installable microphone for an implantable hearing aid according to another embodiment of the present invention. Referring to 4A, 4B, and 5, an implantable microphone 10 according to an embodiment of the present invention includes a body part 400 including a cylindrical housing 410 that is installed to pass through a tympanum, a microphone controller (see reference 150 of FIG. 2) installed within the housing 410 to convert an acoustic signal into an electrical signal, and a wire connection part (not shown, reference numeral 300 of FIG. 2) disposed in a middle ear cavity and connected to a hearing aid, and an acoustic collection part 500 that is screw-coupled through a side surface (an edge) of an end of the body part 400 in a direction of an external auditory meatus to collect external sounds and transmit the sounds into the body part 400. The acoustic collection part 500 has a structure in which a cylindrical housing 510 is screw-coupled to an acoustic collection tube 570 having a hopper shape and a front surface on which a metal membrane 575 is formed.

That is, according to the current embodiment of FIGS. 4A, 4B, and 5, the cylindrical body part 400 and the acoustic collection part 500 (the cylindrical housing 410 of the body part 400 and the cylindrical housing 510 of the acoustic collection part 500) are screw-coupled to each other. The acoustic collection tube 570 having the hopper shape is screw-coupled to an edge of the cylindrical housing 510 of the acoustic collection part 500 in the direction of the external auditory meatus. That is, disk-shaped circular plates 430 and 530 each of which has a diameter greater than that of each of the cylindrical housing 410 and 510 are disposed on ends (for example, in the direction of the external auditory meatus in the drawings) of the body part 400 and the acoustic collection part 500. A stepped portion having a ring shape for fixing the tympanum to both sides thereof is disposed on each of the body part 400 and the acoustic collection part 500, and also, the acoustic collection part 500 is screw-coupled to the outside (the edge) of the housing 410 of the body part 400. The separable coupling structure as described above may have advantages in which the microphone is easily installed on the tympanum and separated as necessary to easily repair and maintain the device.

Also, according to the embodiment of FIGS. 4A and 4B, a circular plate 540 is disposed on a front surface of the cylindrical housing 510 coupled to the acoustic collection tube 570 in the acoustic collection part 500. At least one acoustic passage 550 is provided in a central portion of the circular plate 540. Then, the acoustic collection tube 570 having a hopper shape may be screw-coupled to the above-described structure to collect external sounds introduced through the external auditory meatus and transmit the collected sounds into the body part 400. According to the embodiment of FIG. 5, the housing 510 of the acoustic collection part 500 may have an opened structure in which the circular plate 540 of FIGS. 4A and 4B are removed. Thus, sounds may be directly transmitted from the acoustic collection tube 570 to the body part 400.

Here, as shown in FIGS. 4A, 4B, and 5, the metal membrane 575 may be formed on the front surface of the acoustic collection tube 570 having the hopper shape. This is done for blocking liquid foreign substances introduced from the outside to prevent the microphone from being damaged by the introduced liquid when the user has a swim or shower. Also, the current embodiment may utilize the method in which the sounds are directly transmitted through the acoustic passage and the method in which a core microphone within the body part 400 reacts through the vibration of the metal membrane 575 to generate electrical signals or convert the sounds into electrical signals, thereby transmitting the electrical signals.

Figure 6A:
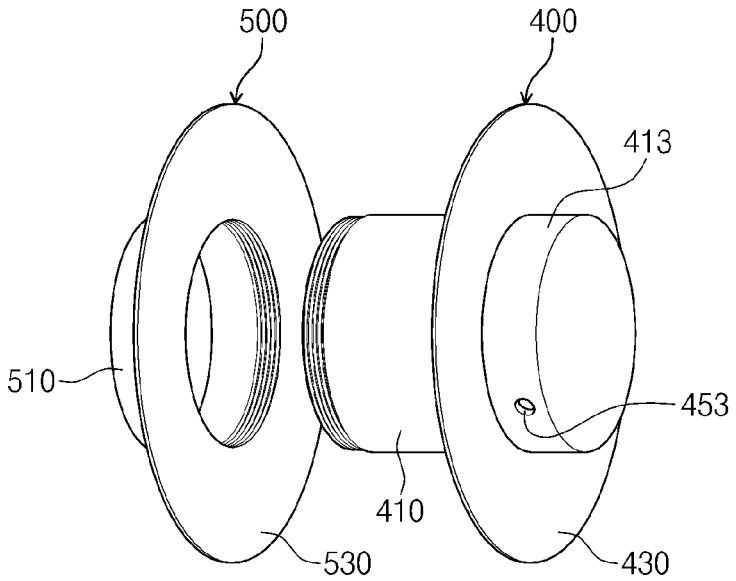
FIGS. 6A and 6B are exploded views of an easily installable microphone for installable implantable hearing aid according to another embodiment of the present invention.
Figure 6B:
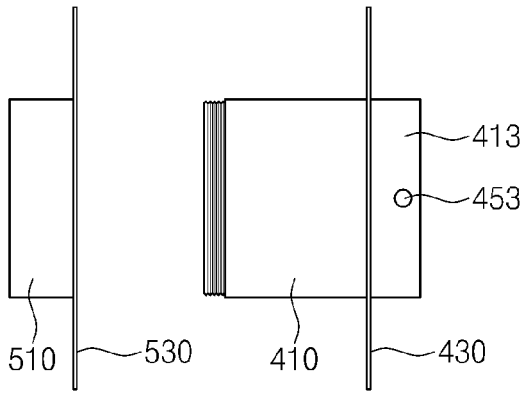

FIGS. 6A and 6B are exploded views of an easily installable microphone for an implantable hearing aid according to another embodiment of the present invention. As illustrated in FIGS. 6A and 6B, unlike the embodiment of FIGS. 4A, 4B, and 5, an acoustic collection part 500 has a structure in which a cylindrical housing 413 having an acoustic passage 453 instead of an acoustic collection tube having a hopper shape is screw-coupled to a cylindrical housing 410 of a body part 400 in an inward direction of a tympanum.

In the current embodiment, the acoustic passage 453 of the cylindrical housing 413 may constitute a portion of the acoustic collection part 500. The acoustic passage 453 may pass through a side surface of the cylindrical housing 413. The acoustic passage 453 may be provided in plurality in the side surface of the cylindrical housing 413. The sounds transmitted through the external auditory meatus may be transmitted into the middle ear cavity through the tympanum and then collected into the body part 400 through the acoustic passage 453, thereby being transmitted into a microphone controller within the body part 400.

According to the current embodiment, the front surface facing the direction of the external auditory meatus of the cylindrical housing 510 may be blocked to prevent external foreign substances or liquid material from being introduced and thus to prevent the microphone from being damaged. That is, the acoustic passage 453 is formed in a side opposite to the external auditory meatus with respect to the tympanum, i.e., the inside of the tympanum. Thus, since the tympanum tissues are self-reproduced after the microphone is implanted into the tympanum, the foreign substances or liquid material introduced through the external auditory meatus may be blocked by the tympanum to prevent the foreign substances or liquid materials from being introduced into the acoustic passage 453.

Figure 6C:
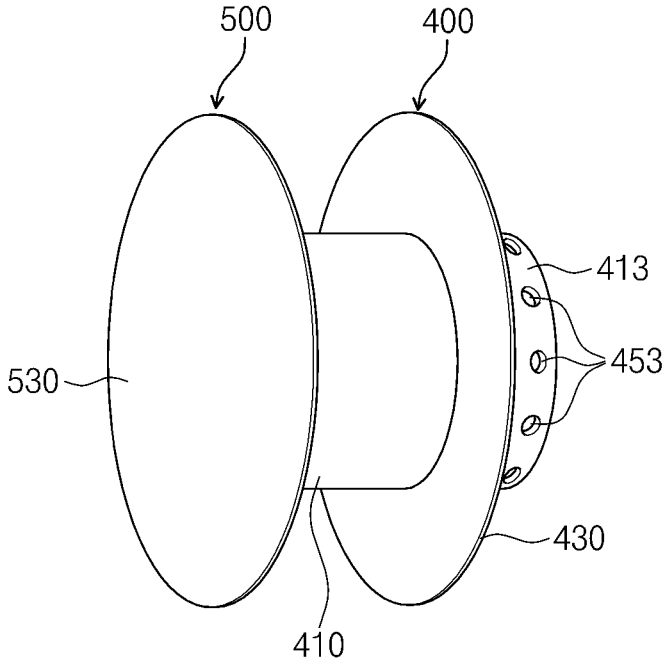
FIG. 6C is a perspective view of the easily installable microphone for the implantable hearing aid according to another embodiment of the present invention.

FIG. 6C is a perspective view of the easily installable microphone for the implantable hearing aid according to another embodiment of the present invention. Referring to FIG. 6C, unlike the embodiment of FIGS. 6A and 6B, the current embodiment has a structure in which a circular plate 530 and housing 413 of an acoustic collection part 500 and a housing 410 and circular plate 430 of the body part 400 are integrated with each other, but the acoustic collection part 500 and the body part 400 are not screw-coupled to each other. According to the current embodiment, a structure may be more simplified, and damage of a microphone due to external foreign substances and liquid materials may be prevented.

Figure 7:
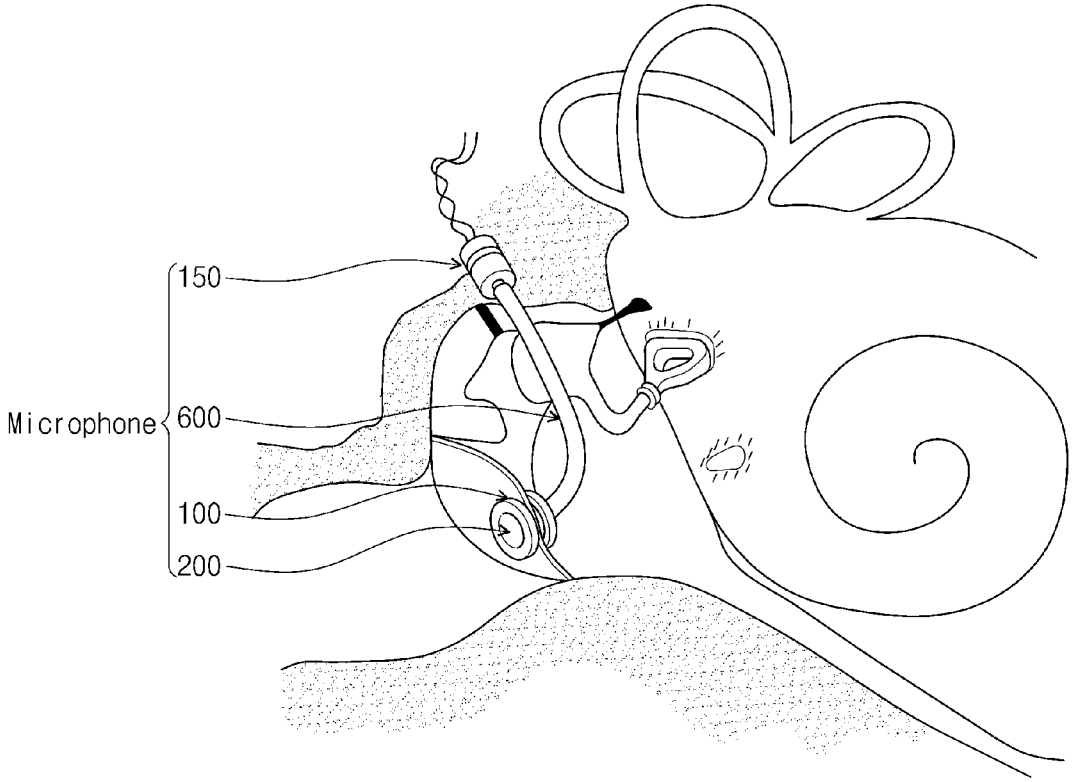
FIG. 7 is a schematic view of an installed state of an easily installable microphone for an implantable hearing ear according to another embodiment of the present invention.
Figure 8A:
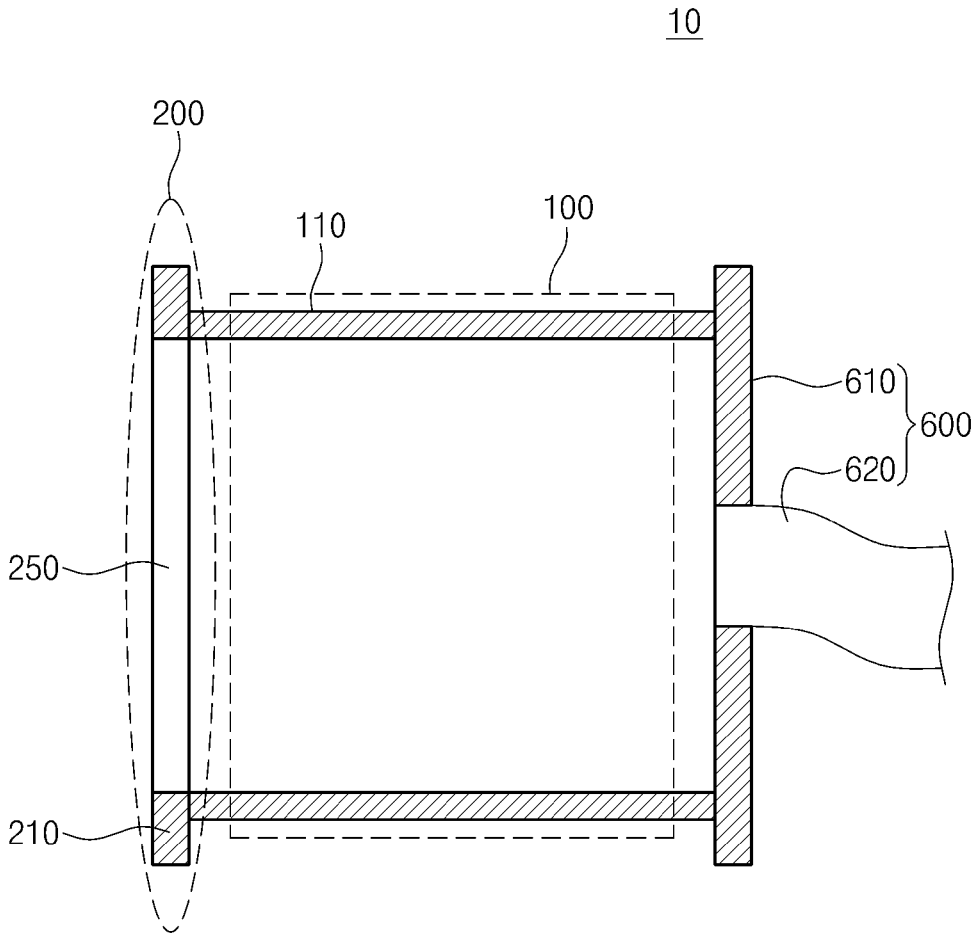
FIG. 8A is a cross-sectional view of the easily installable microphone for the implantable hearing ear of FIG. 7.

FIG. 7 is a schematic view of an installed state of an easily installable microphone for an implantable hearing ear according to another embodiment of the present invention, and FIG. 8A is a cross-sectional view of the easily installable microphone for the implantable hearing ear of FIG. 7. Referring to FIGS. 7 and 8, an implantable microphone 10 according to an embodiment of the present invention includes a body part 100 including a cylindrical housing 110 that is installed to pass through a tympanum, an acoustic collection part 200 that provides a passage for transmitting external sounds into the body part 100, the acoustic collection part 200 being disposed on one side (a left side in drawings) that is a front surface of the body part 100 in a direction of an external auditory meatus, an acoustic transfer part 600 disposed on the other side (a right side in the drawings) that is a rear surface of the body part 100 in a direction of a middle ear cavity, and a microphone controller 150 implanted into a human body to convert an acoustic signal transmitted through the acoustic transfer part 600 into an electrical signal.

As illustrated in FIGS. 7 and 8A, the current embodiment is different from the foregoing embodiments in that the microphone controller 150 is separated from the body part 100 and the acoustic collection part 200 and implanted into the other portion (for example, in the middle ear cavity or an inner wall of the middle ear cavity) except for the tympanum, and acoustic signals collected into the body part 100 by the acoustic collection part 200 are transmitted into the microphone controller 150 through the acoustic transfer part 600. Hereinafter, in descriptions of the embodiments with reference to the drawings, descriptions with respect to the same constitution and configuration as the foregoing embodiments will be omitted. Also, the same reference numeral will be used to denote the same components or similar components in the drawings.

An acoustic transfer part 600 includes a circular plate 610 for finishing an end of a cylindrical housing 110 and an acoustic transfer tube 620 having a tube shape to transmit acoustic signals. The circular plate 610 of the acoustic transfer part 600 may have a diameter greater than that of the cylindrical housing 110 of the body part 100. This is done for a reason in which the microphone body part 100 is seated on a tympanum, and the circular plates 210 and 610 disposed on both ends of the body part 100 serve as one stepped portion to fix the microphone. Similar to the circular plate 210 of the housing 110, the circular plate 610 of the acoustic transfer part 600 may also be made of a biocompatible material. An acoustic passage 250 passing through a central portion of the circular plate 210 of the acoustic collection part 200 is defined in one end of the body part 100 in a direction of an external auditory meatus. In FIG. 8, although the acoustic passage 250 has the same inner diameter as the housing 110, the acoustic passage 250 may have an inner diameter less than that of the housing 110. The entire or an outer surface of the acoustic transfer tube 620 may be coated with a material such as biocompatible parylene.

The microphone controller 150 may be implanted into a middle ear cavity or an inner wall of the middle ear cavity. In this case, since the microphone controller 150 has a less influence on water, moisture, or other foreign substance which is introduced through the external auditory meatus when compared to the microphone installed in the tympanum, damage of the microphone may be effectively prevented. The microphone controller 150 receives acoustic signals transmitted through the acoustic transfer tube 620 to convert the acoustic signals into electrical signals. The microphone controller 150 may include a MEMS converting unit for converting the acoustic signals into the electrical signals and a signal processing unit for amplifying the acoustic signals and removing noises. The microphone controller 150 may be connected to a hearing aid through a wire.

Figure 8B:
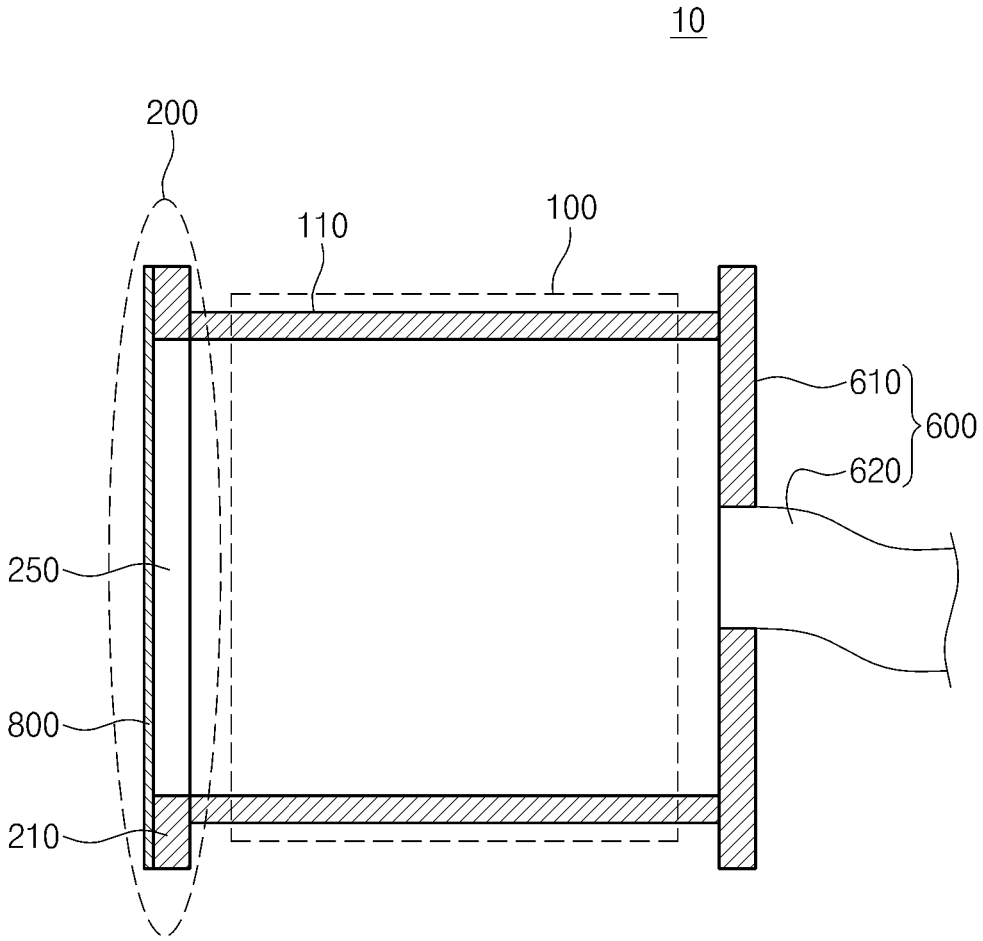
FIG. 8B is a cross-sectional view of the easily installable microphone for the implantable hearing aid according to another embodiment of the present invention.

FIG. 8B is a perspective view of the easily installable microphone for the implantable hearing aid according to another embodiment of the present invention. Referring to FIG. 8B, a waterproof film 800 formed of a waterproof material may be disposed on a front surface of the acoustic collection part 200 in the direction of the external auditory meatus to cover the acoustic passage 250. The waterproof film 800 may maintain collection efficiency of the acoustic collection part 200 to a predetermined level. Also, the waterproof film 800 may have a very thin film shape. A metal membrane may be used as the waterproof film 800. The waterproof film 800 may prevent liquid foreign substances introduced from the outside through the external auditory meatus from being introduced into the microphone. Thus, the waterproof film 800 may prevent acoustic transfer efficiency from being deteriorated due to the introduction of the liquid into the acoustic transfer tube 620 when a user has a swim or shower and prevent the microphone from being damaged due to the introduction of the introduced fluid into the microphone controller 150.

Figure 9:
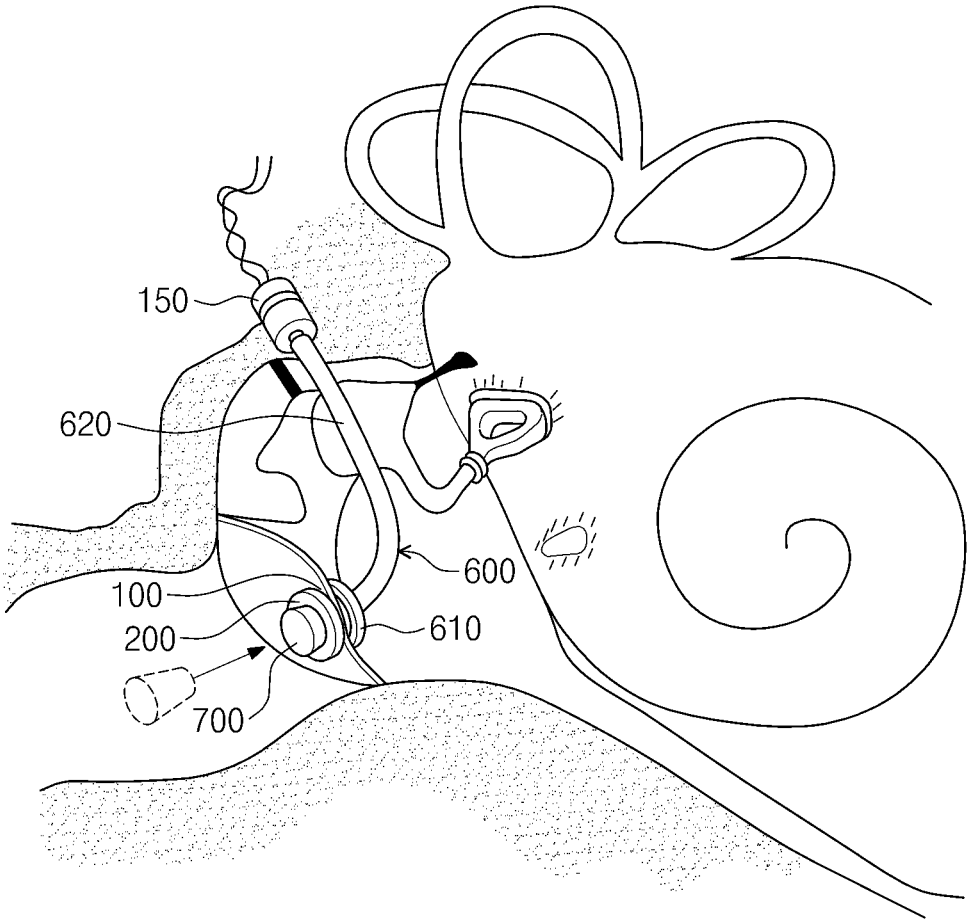
FIG. 9 is a schematic view of an installed state of an easily installable microphone for an implantable hearing ear according to another embodiment of the present invention.

FIG. 9 is a schematic view of an installed state of an easily installable microphone for an implantable hearing ear according to another embodiment of the present invention. Referring to FIG. 9, a waterproof member 700 that blocks acoustic passage 250 to prevent water from being into the tympanum or an acoustic transfer tube 620 may be disposed on an end of an acoustic collection part 200 in a direction of an external auditory meatus. A stopper, cotton, or sponge may be used as the waterproof member 700. The waterproof member 700 may be removed from the acoustic passage 250 so as to insert the waterproof member 700 into the acoustic passage 250 or replace the waterproof member 700 with a new waterproof member by using a thin pin or subminiature tongs.

Figure 10A:
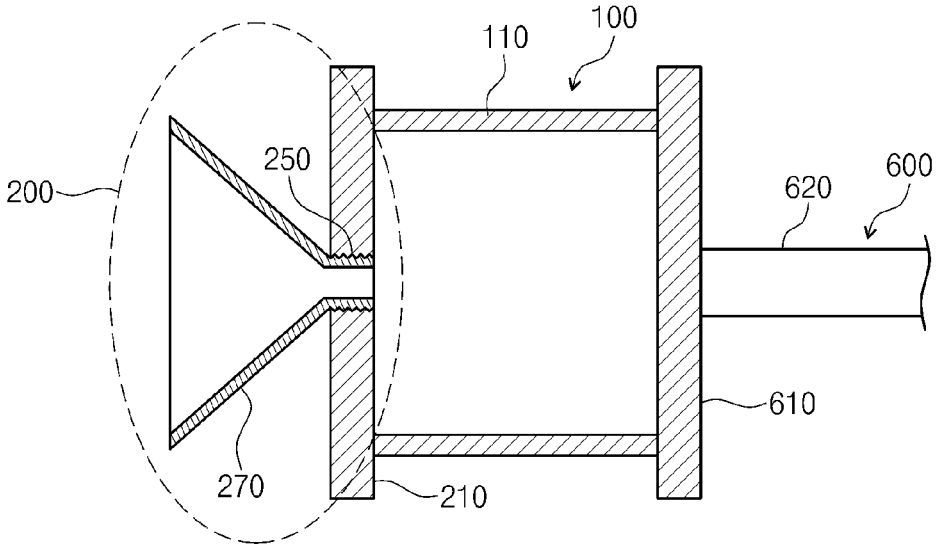
FIG. 10A is a cross-sectional view of an easily installable microphone for an implantable hearing aid according to another embodiment of the present invention.
Figure 10B:
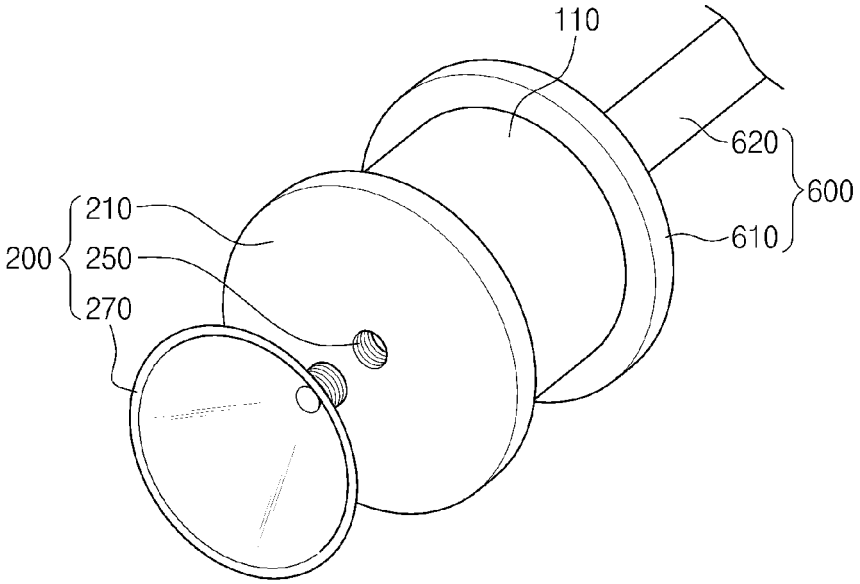
FIG. 10B is a perspective view of the easily installable microphone for the implantable hearing aid according to another embodiment of the present invention.

FIG. 10A is a cross-sectional view of an easily installable microphone for an implantable hearing aid according to another embodiment of the present invention, and FIG. 10B is a perspective view of the easily installable microphone for the implantable hearing aid according to another embodiment of the present invention. Referring to FIGS. 10A and 10B, like the embodiment of FIGS. 3A and 3B, an acoustic collection part 200 of the microphone according to an embodiment of the present invention may have a structure in which an acoustic collection tube 270 having a hopper shape extends in an acoustic collection passage 250 to more effectively collect sounds introduced through an external auditory meatus.

However, as illustrated in FIGS. 10 and 10A, the current embodiment is different from the embodiment of FIGS. 3A and 3B in that a microphone controller 150 is separated from a body part 100 and an acoustic collection part 200 and implanted into the other portion (for example, in the middle ear cavity or an inner wall of the middle ear cavity) except for the tympanum, and acoustic signals collected into the body part 100 by the acoustic collection part 200 are transmitted into the microphone controller 150 through an acoustic transfer part 600.

Figure 11A:
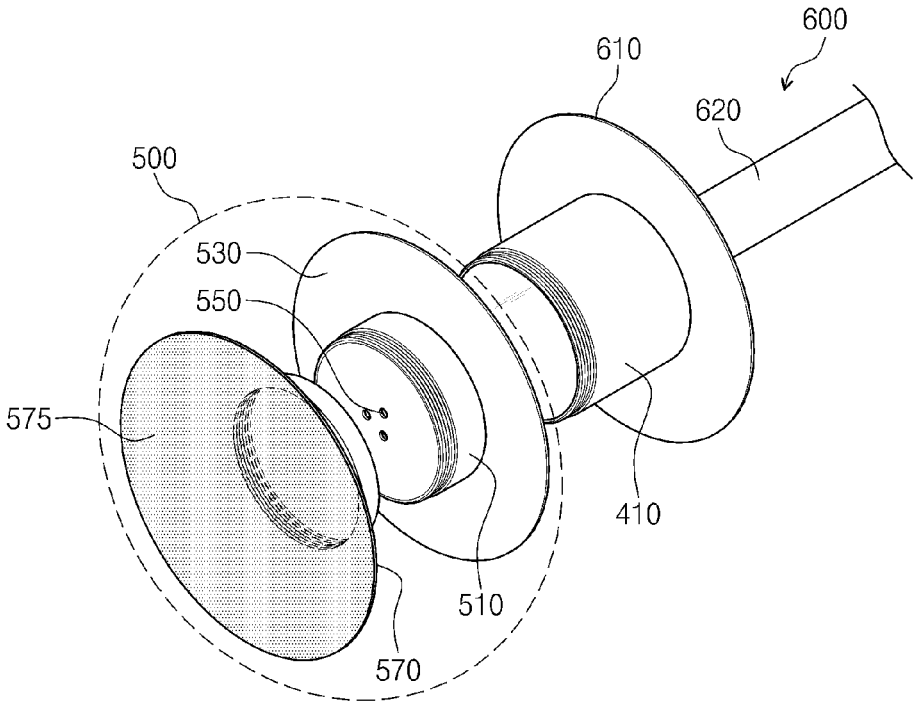
FIGS. 11A and 11B are exploded views of an easily installable microphone for an implantable hearing aid according to another embodiment of the present invention.
Figure 11B:
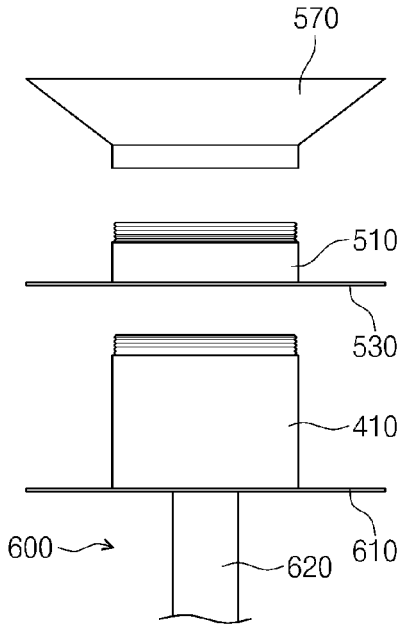
Figure 12:
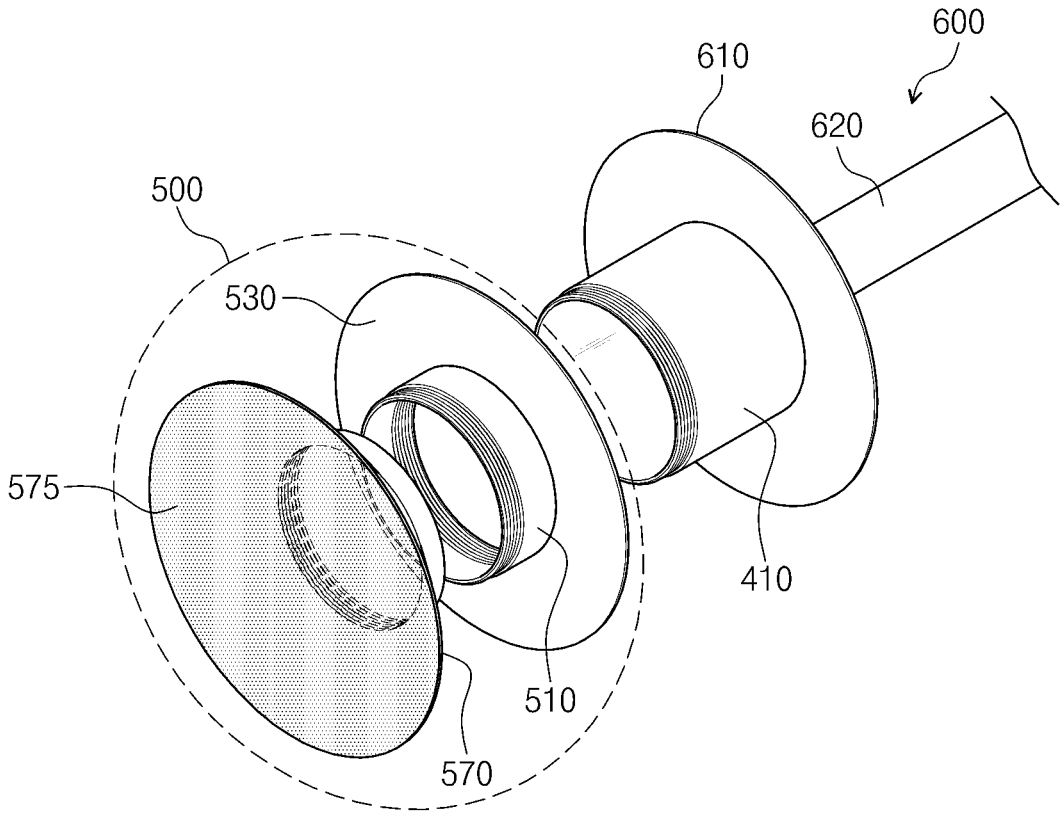
FIG. 12 is an exploded view of an easily installable microphone for an implantable hearing aid according to another embodiment of the present invention.

FIGS. 11A and 11B and 12 are exploded views of an easily installable microphone for an implantable hearing aid according to another embodiment of the present invention. Referring to 11A, 11B, and 12, like the embodiment of FIGS. 4A, 4B, and 5, a microphone according to an embodiment of the present invention includes a body part 400 including a cylindrical housing 410 that is installed to pass through a tympanum, and an acoustic collection part 500 that is screw-coupled through a side surface (an edge) of an end of the body part 400 in a direction of an external auditory meatus to collect external sounds and transmit the sounds into the body part 400. The acoustic collection part 500 has a structure in which a cylindrical housing 510 is screw-coupled to an acoustic collection tube 570 having a hopper shape and a front surface on which a metal membrane is formed.

However, as illustrated in FIGS. 11A, 11B, and 12, the current embodiment is different from the embodiment of FIGS. 4A, 4B, and 5 in that a microphone controller 150 is separated from a body part 400 and an acoustic collection part 500 and implanted into the other portion (for example, in the middle ear cavity or an inner wall of the middle ear cavity) except for the tympanum, and acoustic signals collected into the body part 400 by the acoustic collection part 500 are transmitted into the microphone controller 150 through an acoustic transfer part 600.

Figure 13A:
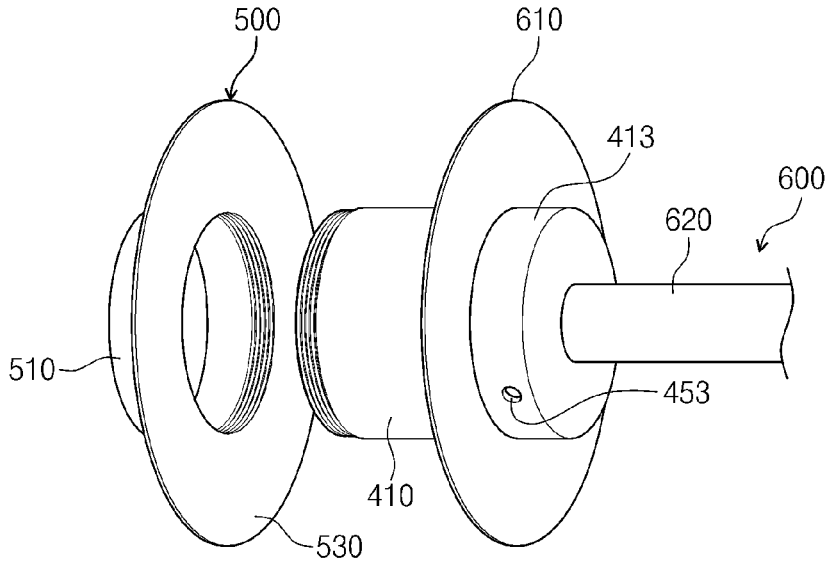
FIGS. 13A and 13B are exploded views of an easily installable microphone for an implantable hearing aid according to another embodiment of the present invention.
Figure 13B:
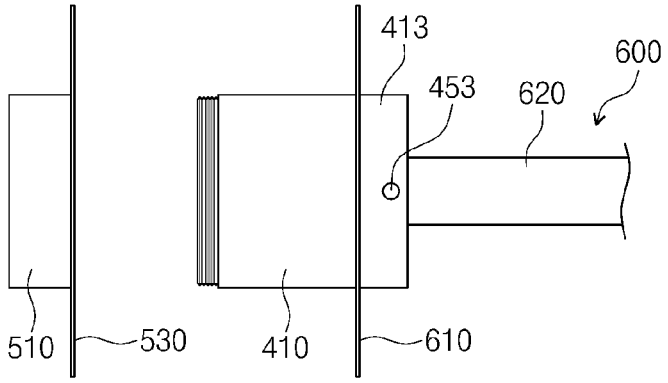

FIGS. 13A and 13B are exploded views of an easily installable microphone for an implantable hearing aid according to another embodiment of the present invention. Referring to FIGS. 13A and 13B, like the embodiment of FIGS. 6A and 6B, the microphone according to an embodiment of the present invention has a structure in which a cylindrical housing 413 of a body part 400 in an inward direction of a tympanum is screw-coupled to a cylindrical housing 410 of the body part 400, a front surface of an acoustic collection part 500 in a direction of an external auditory meatus is blocked, and an acoustic passage 453 is defined in a side surface of the housing 413. According to the above-described structure, a structure may be more simplified, and damage of a microphone due to external foreign substances and liquid materials may be prevented.

However, as illustrated in FIGS. 13A and 13B, the current embodiment is different from the embodiment of FIGS. 6A and 6B in that a microphone controller 150 is separated from a body part 400 and an acoustic collection part 500 and implanted into the other portion (for example, in the middle ear cavity or an inner wall of the middle ear cavity) except for the tympanum, and acoustic signals collected into the body part 400 by the acoustic collection part 500 are transmitted into the microphone controller 150 through an acoustic transfer part 600.

Figure 13C:
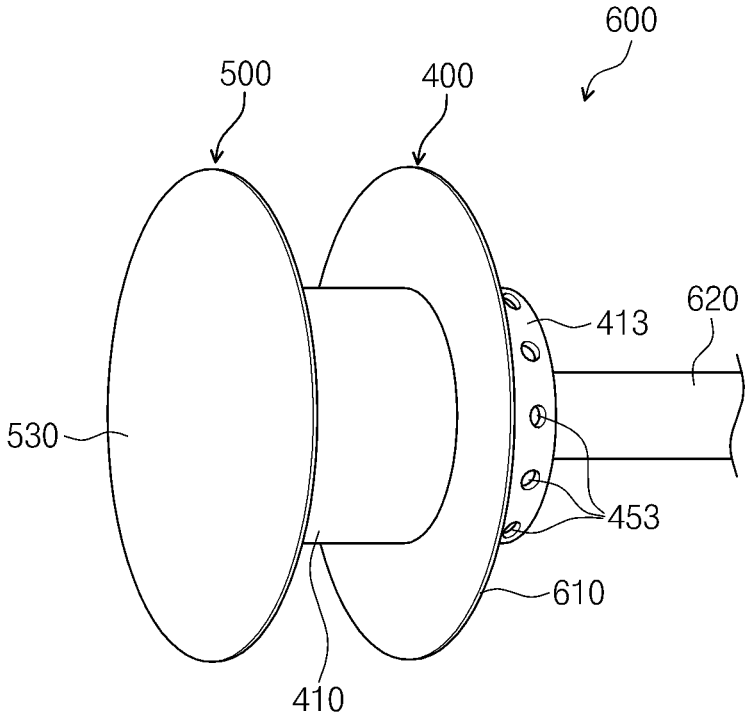
FIG. 13C is a perspective view illustrating the easily installable microphone for the implantable hearing aid according to another embodiment of the present invention.

FIG. 13C is a perspective view illustrating the easily installable microphone for the implantable hearing aid according to another embodiment of the present invention. Referring to FIG. 13C, the current embodiment is different from the embodiment of FIGS. 13A and 13B in that a circular plate 530 and housing 413 of an acoustic collection part 500 and a housing 410 and circular plate 430 of the body part 400 are integrated with each other, but the acoustic collection part 500 and the body part 400 are not screw-coupled to each other. According to the current embodiment, a structure may be very simplified, and damage of a microphone due to external foreign substances and liquid materials may be prevented.

As described above, when compared to the typical method, the microphone may be easily installed on the tympanum in the noninvasive manner, and the attenuation in sensibility of the microphone may be prevented. Thus, the microphone according to the present invention may be significantly utilized for the implantable hearing aid.

Also, since the subminiature microphone installed on the tympanum is disposed on a boundary between the external ear and the middle ear, acoustic energy collected by the external ear may be converted as it is into electrical signal by the microphone to improve the sensibility. Also, since a surface of the microphone faces the external auditory meatus, sensibility with respect to sounds that is feedback from an internal ear may be very low to prevent an existing howling effect from occurring.

According to the embodiments of the present invention, the body part including the acoustic collection part may be easily installed on the tympanum in the noninvasive manner.

While the present invention has been shown and described in connection with the exemplary embodiments, it will be apparent to those skilled in the art that modifications and variations can be made without departing from the spirit and scope of the invention as defined by the appended claims.

What is claimed is:

1. A microphone for an implantable hearing aid, the microphone comprising:

a body part comprising a cylindrical housing installed passing through a tympanum and a microphone controller installed within the cylindrical housing to convert an acoustic signal into an electrical signal;

an acoustic collection part that provides a passage for transmitting external sounds into the body part, the acoustic collection part being disposed on one end of the body part in a direction of an external auditory meatus; and a wire connection part connecting the microphone controller to the implantable hearing aid, the wire connection part being disposed on the other end of the body part in a direction of a middle ear cavity, wherein the acoustic collection part comprises:

at least one acoustic passage in the direction of the external auditory meatus; and a membrane detecting the external sounds and providing the passage for transmitting the external sounds according to a motion of the membrane and not according to a motion of the tympanum, the membrane being disposed on an end of the acoustic collection part in the direction of the external auditory meatus to cover the at least one acoustic passage, wherein the at least one acoustic passage is provided in a central portion of a first circular plate of the acoustic collection part, and an acoustic collection tube having a hopper shape is installed in the acoustic passage in the direction of the external auditory meatus.

2. The microphone of claim 1, wherein the microphone controller comprises:

a converting part converting the acoustic signal into the electrical signal; and a signal processing part amplifying the acoustic signal and removing noises of the acoustic signal.

3. The microphone of claim 1, wherein the wire connection part comprises a second circular plate for finishing an end of the cylindrical housing of the body part, and each of the first circular plate and the second circular plate has a diameter greater than that of the cylindrical housing of the body part.

4. A microphone for an implantable hearing aid, the microphone comprising:

a body part comprising a first cylindrical housing installed passing through a tympanum, a microphone controller installed within the cylindrical housing to convert an acoustic signal into an electrical signal, a wire connection part disposed on one end of the first cylindrical housing to connect the microphone controller to the implantable hearing aid; and an acoustic collection part screw-coupled to the other end of the first cylindrical housing to collect external sounds, the acoustic collection part providing a passage for transmitting the external sounds into the body part, wherein the acoustic collection part comprises:

at least one acoustic passage in a direction of an external auditory meatus; and a membrane detecting the external sounds and providing the passage for transmitting the external sounds according to a motion of the membrane and not according to a motion of the tympanum, the membrane being disposed on an end of the acoustic collection part in the direction of the external auditory meatus to cover the at least one acoustic passage, wherein the at least one acoustic passage is provided in a central portion of a circular plate of the acoustic collection part, and an acoustic collection tube having a hopper shape is installed in the acoustic passage in the direction of the external auditory meatus.

5. The microphone of claim 4, wherein the microphone controller comprises:

a converting part converting the acoustic signal into the electrical signal; and a signal processing part amplifying the acoustic signal and removing noises of the acoustic signal.

6. The microphone of claim 4, wherein the circular plate has a diameter greater than that of the first cylindrical housing of the body part.

7. The microphone of claim 4, wherein the acoustic collection part further comprises:

a second cylindrical housing that is opened in the direction of the external auditory meatus, wherein the membrane comprises a metal membrane, the metal membrane being disposed on a front surface of the second cylindrical housing in the direction of the external auditory meatus, the metal membrane comprising a waterproof material and configured to vibrate according to the acoustic signal.

8. The microphone of claim 6, wherein the acoustic collection part further comprises a second cylindrical housing that is opened in the direction of the external auditory meatus, and wherein the acoustic collection tube is screw-coupled to one end of the second cylindrical housing.

9. The microphone of claim 8, wherein the membrane comprises a metal membrane, the metal membrane being disposed on the acoustic collection tube.

10. A microphone for an implantable hearing aid, the microphone comprising:

a body part comprising a cylindrical housing installed passing through a tympanum;

an acoustic collection part that provides a passage for transmitting external sounds into the body part, the acoustic collection part being disposed on one end of the body part in a direction of an external auditory meatus; and an acoustic transfer part disposed on the other end of the body part in a direction of a middle ear cavity to transmit an acoustic signal into a microphone controller, wherein the microphone controller is implanted into the middle ear cavity to convert the acoustic signal transmitted through the acoustic transfer part into an electrical signal, wherein the acoustic transfer part comprises an acoustic transfer tube, the acoustic transfer tube transmitting the acoustic signal to the microphone controller, and wherein the acoustic collection part comprises:

at least one acoustic passage in the direction of the external auditory meatus; and a membrane detecting the external sounds and providing the passage for transmitting the external sounds according to a motion of the membrane and not according to a motion of the tympanum, the membrane being disposed on an end of the acoustic collection part in the direction of the external auditory meatus to cover the at least one acoustic passage, wherein the at least one acoustic passage is provided in a central portion of a first circular plate of the acoustic collection part, and an acoustic collection tube having a hopper shape is installed in the acoustic passage in the direction of the external auditory meatus.

11. The microphone of claim 10, wherein the acoustic transfer part further comprises a second circular plate for finishing an end of the cylindrical housing, the second circular plate having a diameter greater than that of the cylindrical housing of the body part.

12. The microphone of claim 10, wherein the membrane comprises a waterproof material, the membrane configured to vibrate according to the acoustic signal.

13. A microphone for an implantable hearing aid, the microphone comprising:

a body part comprising a housing that is implantable in a tympanum and a microphone controller installed within the housing to convert an acoustic signal into an electrical signal; and an acoustic collection part that provides a passage for transmitting external sounds into the body part, the acoustic collection part being disposed on one end of the body part, wherein the acoustic collection part has an outer surface expanded from the housing on one end of the housing, wherein the acoustic collection part comprises:

at least one acoustic passage in a direction of an external auditory meatus; and a membrane detecting the external sounds and providing the passage for transmitting the external sounds according to a motion of the membrane and not according to a motion of the tympanum, the membrane being disposed on an end of the acoustic collection part in the direction of the external auditory meatus to cover the at least one acoustic passage, wherein the at least one acoustic passage is provided in a central portion of a circular plate of the acoustic collection part, and an acoustic collection tube having a hopper shape is installed in the acoustic passage in the direction of the external auditory meatus.

14. A microphone for an implantable hearing aid, the microphone comprising:

a body part comprising a housing that is implantable in a tympanum;

an acoustic collection part that provides a passage for transmitting external sounds into the body part, the acoustic collection part being disposed on one end of the body part; and an acoustic transfer part disposed on the other end of the body part to transmit an acoustic signal into a microphone controller, wherein the acoustic collection part comprises:

a first member having an outer surface expanded from the housing on one end of the housing;

at least one acoustic passage in the direction of a external auditory meatus; and a membrane detecting the external sounds and providing the passage for transmitting the external sounds according to a motion of the membrane and not according to a motion of the tympanum, the membrane being disposed on an end of the acoustic collection part in the direction of the external auditory meatus to cover the at least one acoustic passage, wherein the microphone controller is implanted into a middle ear cavity to convert the acoustic signal transmitted through the acoustic transfer part into an electrical signal, and wherein the acoustic transfer part comprises:

a second member having an outer surface expanded from the housing on the other end of the housing; and an acoustic transfer tube transmitting the acoustic signal to the microphone controller, wherein the at least one acoustic passage is provided in a central portion of a circular plate of the acoustic collection part, and an acoustic collection tube having a hopper shape is installed in the acoustic passage in the direction of the external auditory meatus.

* * * * *